US007462985B2

(12) United States Patent
Nishimura

(10) Patent No.: US 7,462,985 B2
(45) Date of Patent: Dec. 9, 2008

(54) PLASMA DISPLAY PANEL

(75) Inventor: Masaki Nishimura, Osaka (JP)

(73) Assignee: Panasonic Corporation, Osaka (JP)

( * ) Notice: Subject to any disclaimer, the term of this patent is extended or adjusted under 35 U.S.C. 154(b) by 429 days.

(21) Appl. No.: 10/566,161

(22) PCT Filed: May 2, 2005

(86) PCT No.: PCT/JP2005/008648

§ 371 (c)(1),
(2), (4) Date: Jan. 27, 2006

(87) PCT Pub. No.: WO2005/109464

PCT Pub. Date: Nov. 17, 2005

(65) Prior Publication Data

US 2006/0273719 A1 Dec. 7, 2006

(30) Foreign Application Priority Data

May 10, 2004 (JP) ..... 2004-139594

(51) Int. Cl.
*H01J 1/02* (2006.01)

(52) U.S. Cl. ..... 313/582; 313/587

(58) Field of Classification Search ..... 313/581–587
See application file for complete search history.

(56) References Cited

U.S. PATENT DOCUMENTS

| | | | | |
|---|---|---|---|---|
| 5,982,095 | A | 11/1999 | Jin et al. | |
| 6,097,150 | A | 8/2000 | Watanabe | |
| 6,172,460 | B1 | 1/2001 | Damen et al. | |
| 6,320,318 | B1 | 11/2001 | Van Slooten et al. | |
| 6,713,958 | B2 * | 3/2004 | Oniki | 313/582 |
| 6,864,631 | B1 * | 3/2005 | Wedding | 313/587 |
| 2003/0218579 | A1 * | 11/2003 | Uemura et al. | 345/60 |

FOREIGN PATENT DOCUMENTS

| | | |
|---|---|---|
| JP | 7-110659 | 4/1995 |
| JP | 8-313883 | 11/1996 |
| JP | 9-92161 | 4/1997 |
| JP | 9-120778 | 5/1997 |
| JP | 9-245653 | 9/1997 |
| JP | 11-153969 | 6/1999 |
| JP | 11-233022 | 8/1999 |
| JP | 11-120920 | 4/2000 |
| JP | 2001-135237 | 5/2001 |

(Continued)

OTHER PUBLICATIONS

H. Uchiike et al., "General Information on Plasma Display", May 1, 1997, pp. 79-80.

*Primary Examiner*—Ashok Patel
(74) *Attorney, Agent, or Firm*—Wenderoth, Lind & Ponack, L.L.P.

(57) ABSTRACT

The plasma display panel disclosed can perform a high brightness displaying and can realize a stable driving on a low drive voltage. The plasma display panel has front substrate (1) and rear substrate (2) positioned facing each other to form discharge spaces in between filled with discharge gas (14), wherein the discharge gas includes at least one of chosen from among helium (He), neon (Ne) and argon (Ar); xenon (Xe) and hydrogen ($H_2$), in which Xe concentration is not lower than 5%.

4 Claims, 4 Drawing Sheets

FOREIGN PATENT DOCUMENTS

| | | |
|---|---|---|
| JP | 2002-75170 | 3/2002 |
| JP | 2002-517893 | 6/2002 |
| JP | 2002-519812 | 7/2002 |
| JP | 2002-352723 | 12/2002 |
| JP | 2004-186021 | 7/2004 |

* cited by examiner

PLASMA DISPLAY PANEL

This application is a U.S. National Phase application of PCT International Application PCT/J P2005/008648

TECHNICAL FIELD

The present invention relates to a plasma display panel for use in a display device or the like.

BACKGROUND ART

The plasma display panel (hereafter referred to as PDP) consists basically of a front substrate and a rear substrate.

The front substrate comprises: a glass substrate; display electrodes including stripe-like transparent electrodes and bus electrodes formed on a principal surface of the glass substrate; a dielectric layer covering the display electrodes to act as a capacitor; and a protective layer composed of MgO formed on the dielectric layer.

The glass substrate adopts a glass substrate produced by float process, a glass manufacturing technology easy for large-sizing and excellent in flattening. The display electrodes include transparent electrodes provided by the TFT (thin film transistor) processing, on which predetermined patterns are formed using a paste including Ag to obtain a sufficient electrical conductivity before sintering it to form the bus electrodes. The dielectric glass layer is formed by sintering a dielectric paste coated so as to cover the display electrodes having the transparent electrodes and bus electrodes. Finally, a protective layer composed of MgO is formed on the dielectric layer by the TFT processing.

The rear substrate comprises: a glass substrate; stripe-like address electrodes formed on a principal surface of the glass substrate; a dielectric layer covering the address electrodes; ribs formed on the dielectric layer; and phosphor layers provided between the ribs internally to emit red, green and blue light respectively.

The front substrate and rear substrate are sealed hermetically so that principal surface sides provided with the electrodes face each other, and the discharge spaces divided by the ribs are filled with discharge gas such as Ne—Xe gas mixture at a pressure of ranging from 400 Torr to 600 Torr.

The PDP allows the display electrodes to discharge by applying image signal voltage selectively, exciting each phosphor layer to emit red, green and blue light by the ultra-violet ray generated in the discharge to perform colored image displaying. The examples are disclosed in "General Information on Plasma Display" by H. Uchiike & S. Mikoshiba, (Tokyo: Kogyo Chosakai Publishing Co., Ltd. May 1, 1997), p. 79 to 80.

In recent years, however, expectations for TV sets with high-resolution and multi-gradation and that consume less power, including high-definition TVs, are increasing rapidly. A fully equipped 42-inch high-definition TV set expected recently has 1920×1125 pixels with a very small cell pitch of 0.15×0.48 mm. The problem of decrease in the brightness and luminous efficiency would become apparently in such a high-resolution PDP.

Measures therefore such as to increase Xe concentration in the discharge gas or to use double-cross shaped ribs for the PDP has been tried. However, increased Xe concentration in the discharge gas or introduction of the double-cross shaped ribs for the PDP could cause a large increase in a drive voltage and an unstable address discharge, thereby causing a problem of obtaining a high picture quality.

The present invention aims at providing a PDP capable of displaying with high brightness and of realizing a stable driving on the low drive voltage.

DISCLOSURE OF THE INVENTION

To accomplish the above purposes the PDP of the present invention has discharge spaces filled with the discharge gas between two substrates positioned facing each other with a gap, wherein the discharge gas is composed of at least one chosen from among helium (He), neon (Ne) and argon (Ar), xenon (Xe) and hydrogen ($H_2$), in which Xe concentration is not lower than 5%.

The configuration, the discharge gas including Xe of the concentration of not lower than 5% added with $H_2$ content, can provide the PDP capable of displaying with high brightness and of realizing a stable driving in the low drive voltage.

DETAILED DESCRIPTIONS OF THE INVENTION

Now, the PDP used in the exemplary embodiment of the present invention is described with reference to the drawings.

Figure 1:
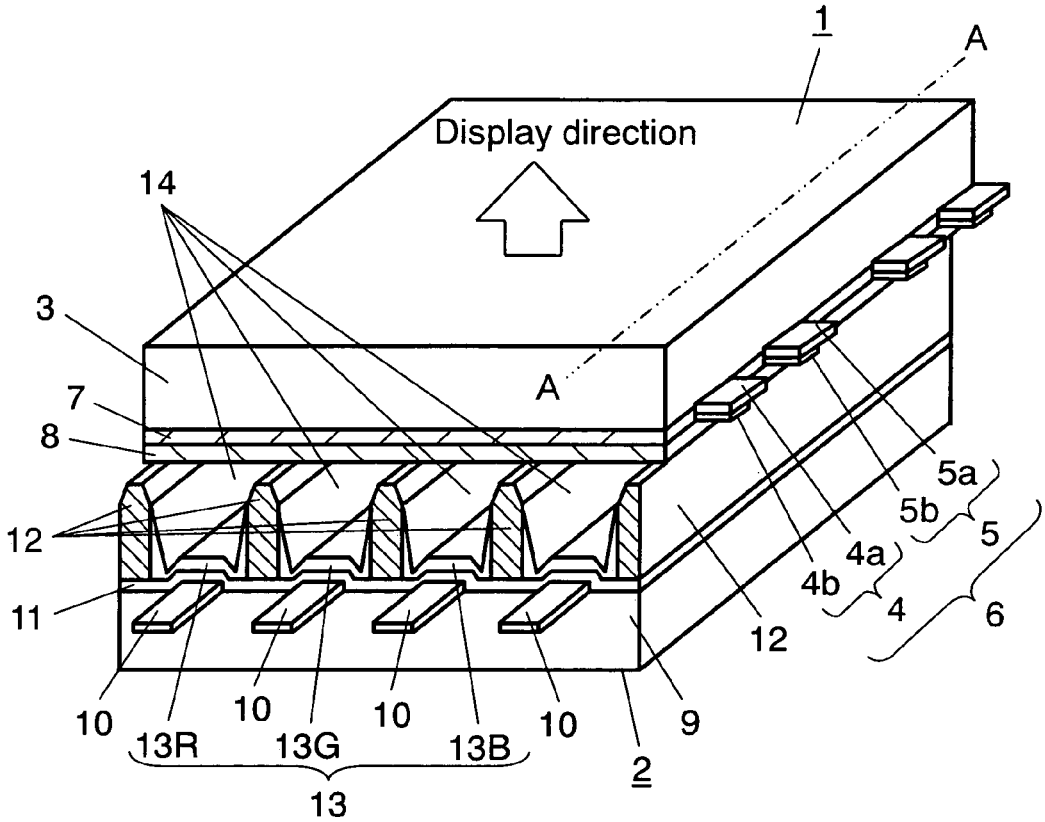
FIG. 1 illustrates a cross-sectional perspective view showing the main structure of the PDP used in the exemplary embodiment of the present invention.
Figure 2:
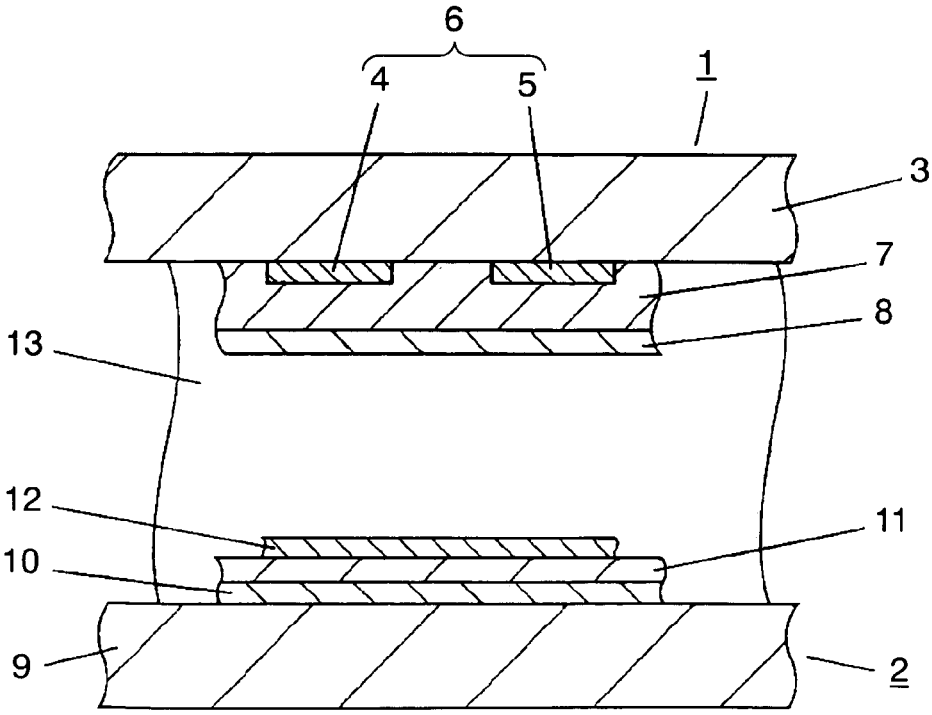
FIG. 2 illustrates a cross-sectional view taken along the line A-A in FIG. 1.

FIG. 1 illustrates a cross-sectional perspective view showing the main portion of the PDP used in the exemplary embodiment of the present invention. FIG. 2 illustrates a cross-sectional view taken along the line A-A in FIG. 1. The PDP comprises front substrate 1 and rear substrate 2 positioned facing each other so that discharge spaces are formed as shown in FIG. 1.

Front substrate 1 is described first.

Front glass substrate 3 has display electrodes 6 including stripe-like scan electrodes 4 and sustain electrodes 5 arranged on a surface facing rear substrate 2 so as to form surface discharge gaps sandwiched between the both electrodes. That is, display electrode 6 comprises a pair of scan electrode 4 and sustain electrode 5 arranged in parallel. Scan electrode 4 and sustain electrode 5 comprise: transparent electrodes 4*a* and 5*a* composed of transparent electrical conductive materials such as indium tin oxide (ITO) or tin dioxide ($SnO_2$); and bus electrodes 4*b* and 5*b*, having a narrower width and a higher electrical conductivity than transparent electrodes 4*a* and 6*a*, formed on transparent electrodes 4*a* and 6*a*. Bus electrodes 4*b* and 5*b* are formed of for instance Ag thick film (thickness:

2 to 10 μm), Al thin film (thickness: 0.1 to 1 μm) or Cr/Cu/Cr multi-layered thin film (thickness: 0.1 to 1 μm).

Dielectric layer 7 composed of dielectric glass materials having a glass composition of for instance PbO—$SiO_2$—$B_2O_3$—ZnO—BaO series is formed on front glass substrate 3 provided with display electrodes 6 so as to cover display electrodes 6, and protective layer 8 is formed multi-layered on the entire surface of dielectric layer 7. MgO-based thin film thus formed is to act as protective layer 8.

Rear substrate 2 is described next.

Rear glass substrate 9 has a plurality of address electrodes 10 formed arranged in stripe-shape on the surface facing front substrate 1. Dielectric layer 11 is formed additionally so as to cover address electrodes 10. Stripe-like ribs 12 for instance are disposed on dielectric layer 11 so as to be arranged between address electrodes 10. Stripe-like grooves surrounded by ribs 12 and dielectric layer 11 are provided with phosphor layers 13: red phosphor layers 13R to emit red light, green phosphor layers 13G to emit green light and blue phosphor layers 13B to emit blue light.

Front substrate 1 and rear substrate 2 thus formed are positioned facing each other so that display electrodes 6 cross address electrodes 10 to form discharge spaces 14 surrounded by stripe-like grooves formed by ribs 12 and respective color phosphor layers 13R, 13G or 13B, and protective layer 8. Front substrate 1 and rear substrate 2 are hermetically sealed in the outer periphery using sealing glasses, and subsequently discharge spaces 14 are filled with discharge gas to complete the PDP. Therefore, areas where display electrodes 6 cross address electrodes 10 work as discharge cells to perform image displaying. Discharge spaces 14 are filled with the discharge gas at a pressure of the order of 400 Torr to 600 Torr.

The PDP generates ultra-violet rays with a short wave length (wave length: approximately 147 nm) in a gas discharge occurring in the discharge cells, and excites respective color phosphor layers 13R, 13G and 13B by the ultra-violet ray to perform image displaying.

In the exemplary embodiment of the present invention, discharge spaces 14 are filled with the discharge gas composed of at least one chosen from among helium (He), neon (Ne) and argon (Ar); xenon (Xe) and hydrogen ($H_2$), in which Xe concentration is not lower than 5%. Increased Xe concentration in the discharge gas enables the PDP to realize a displaying with high-brightness. However, a higher Xe concentration increases the discharge voltage, causing circuit parts and PDP structure to need measures to withstand a higher voltage, thereby causing increase in power consumption and parts cost eventually.

The PDP used in the exemplary embodiment of the present invention employs the discharge gas with an increased Xe concentration and with additional $H_2$ content, enabling the prevention of the discharge voltage from increasing to perform a stable operation while realizing the display with a high brightness.

Now, sample PDPs have been manufactured to check characteristics of the PDP used in the exemplary embodiment of the present invention. The test samples include Xe concentration of 5%, 15% and 30% respectively, with $H_2$ content varying in concentration for each Xe concentration. The sample PDPs have been finished manufactured with discharge cells 14 filled with the discharge gas, including Ne as a buffer gas, at a pressure of 66.7 kPa (500 Torr). The discharge voltage is measured in each sample subsequently.

Figure 3:
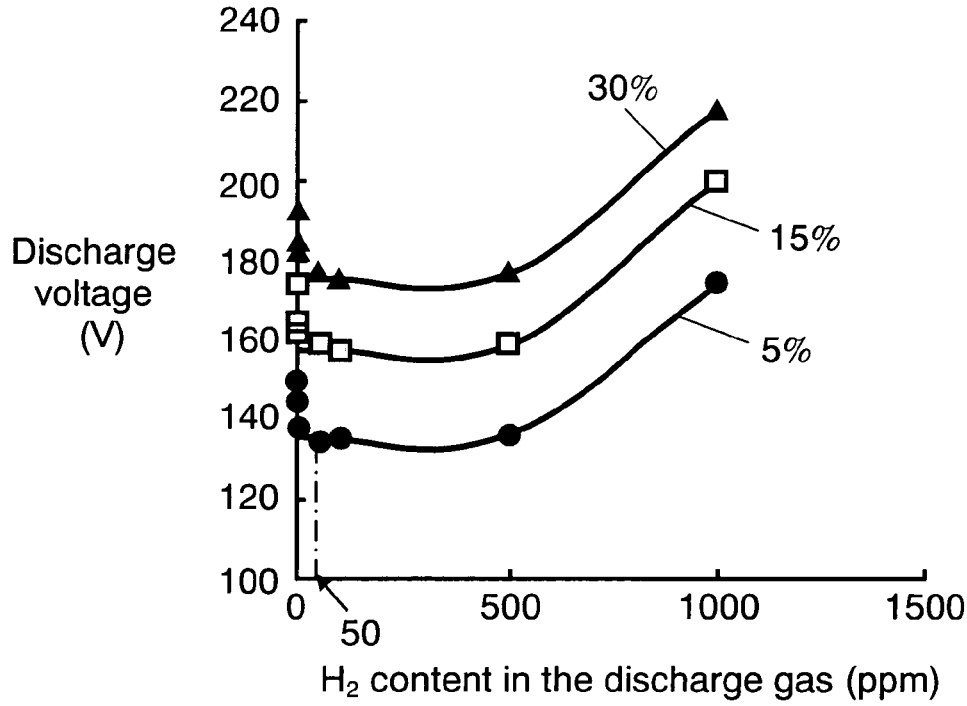
FIG. 3 illustrates the relationship between $H_2$ concentration in the discharge gas and the discharge voltage of the PDP used in the exemplary embodiment of the present invention.

FIG. 3 shows the relationship between $H_2$ content in the discharge gas and the discharge voltage. The least amount of $H_2$ content added to the discharge gas effects a decrease in the discharge voltage in every Xe concentration as shown in FIG. 3. On the contrary, if $H_2$ concentration reaches of the order of a few percent, the discharge voltage proves to show an increase inversely. Namely, it proves that $H_2$ concentration of not higher than 0.1% or preferably not larger than 500 ppm can decrease the discharge voltage more than the case without any $H_2$ content.

Additionally, an $H_2$ concentration ranging from 50 ppm to 500 ppm proves to have approximately the same effects on a decrease in the discharge voltage, showing approximately a constant value over the range. That is, if $H_2$ content to the discharge gas is controlled in the concentration range, it may be preferable to practical manufacturing of the PDP because the effects on decrease in the discharge voltage may be stable if the concentration of $H_2$ content fluctuates slightly.

Figure 4:
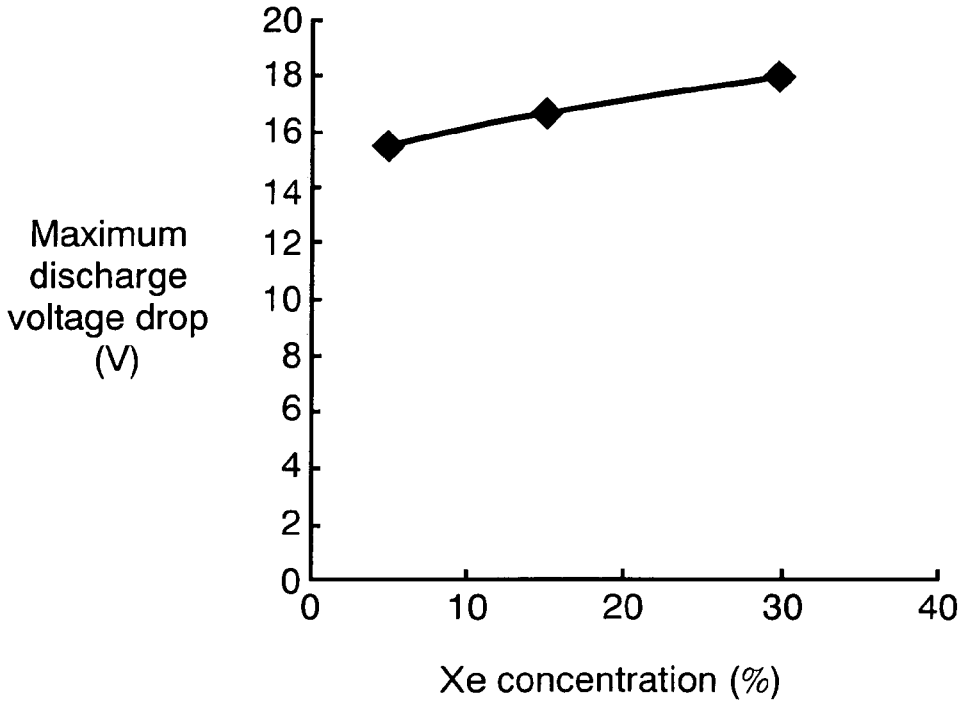
FIG. 4 illustrates the relationship between Xe concentration in the discharge gas and the maximum discharge voltage drop for the PDP.

FIG. 4 illustrates the relationship between Xe concentration in the discharge gas and the maximum discharge voltage drop, showing differences between the discharge voltage in the case without any $H_2$ content and the discharge voltage minimized by adding $H_2$ content in each Xe concentration.

FIG. 4 proves that $H_2$ content can decrease the discharge voltage in every Xe concentration, and that the maximum drop of the discharge voltage amounts to ranging approximately 15 V to 18 V. Also it proves that the higher Xe concentration, the larger the voltage lowering effect.

Figure 5:
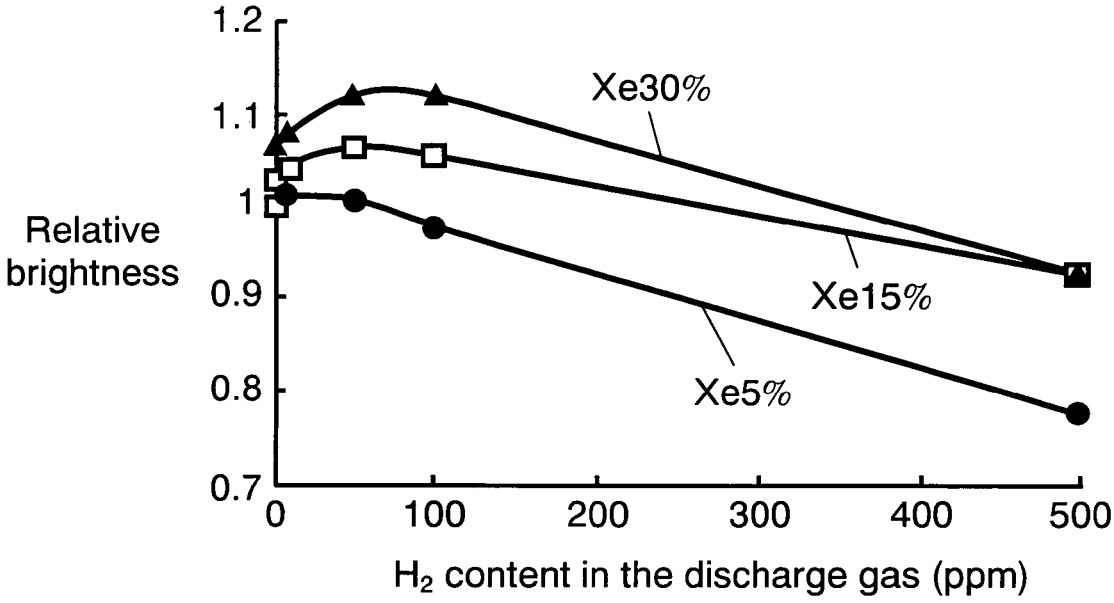
FIG. 5 illustrates a view showing brightness variations on $H_2$ concentration in the discharge gas for the PDP.

FIG. 5 illustrates a view showing variations of display brightness against $H_2$ concentration in the discharge gas. Relative brightness on the same discharge voltage is shown, taking the brightness in the case without any $H_2$ content as a normal of 1 in each Xe concentration. FIG. 5 proves that the brightness shows the maximal value with $H_2$ concentration of not higher than 100 ppm in every Xe concentration.

Figure 6:
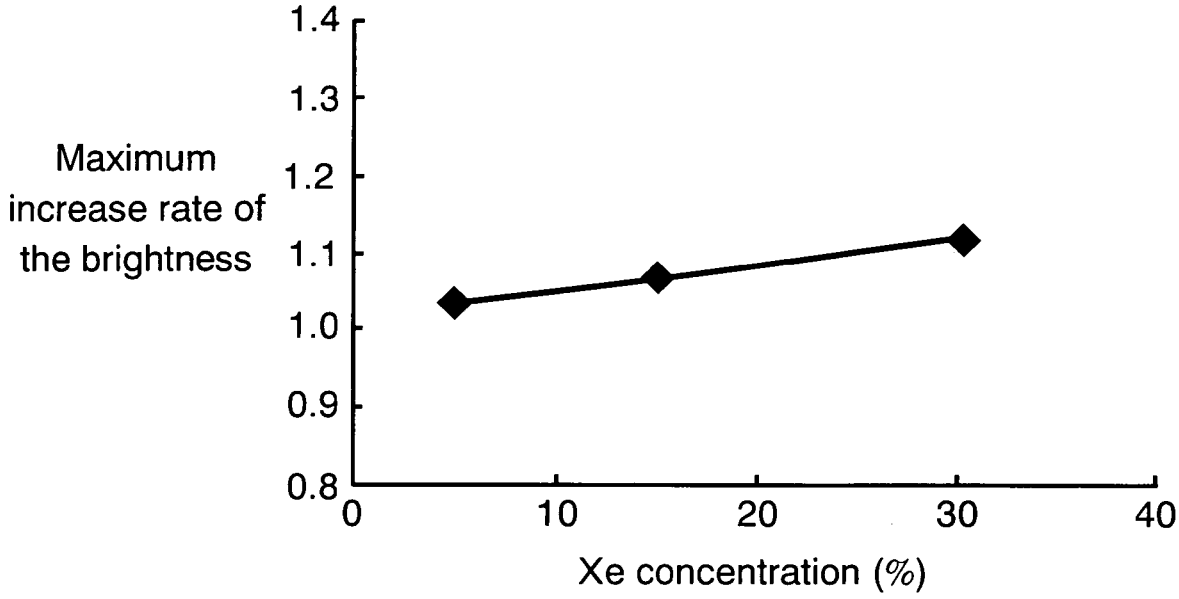
FIG. 6 illustrates the relationship between Xe concentration in the discharge gas and the maximum increase rate of brightness for the PDP.

FIG. 6 illustrates the relationship between Xe concentration in the discharge gas and the maximum increase rate of the brightness. The brightness maximized by adding $H_2$ content in each Xe concentration is shown in increase rate, taking the brightness in the case without any $H_2$ content as a normal of 1. FIG. 6 proves that the higher the Xe concentration, the larger the increase rate of brightness by adding $H_2$ content.

The aforementioned results prove that addition of $H_2$ content of not higher than 100 ppm can decrease the discharge voltage and can realize the display with high-brightness.

Figure 7:
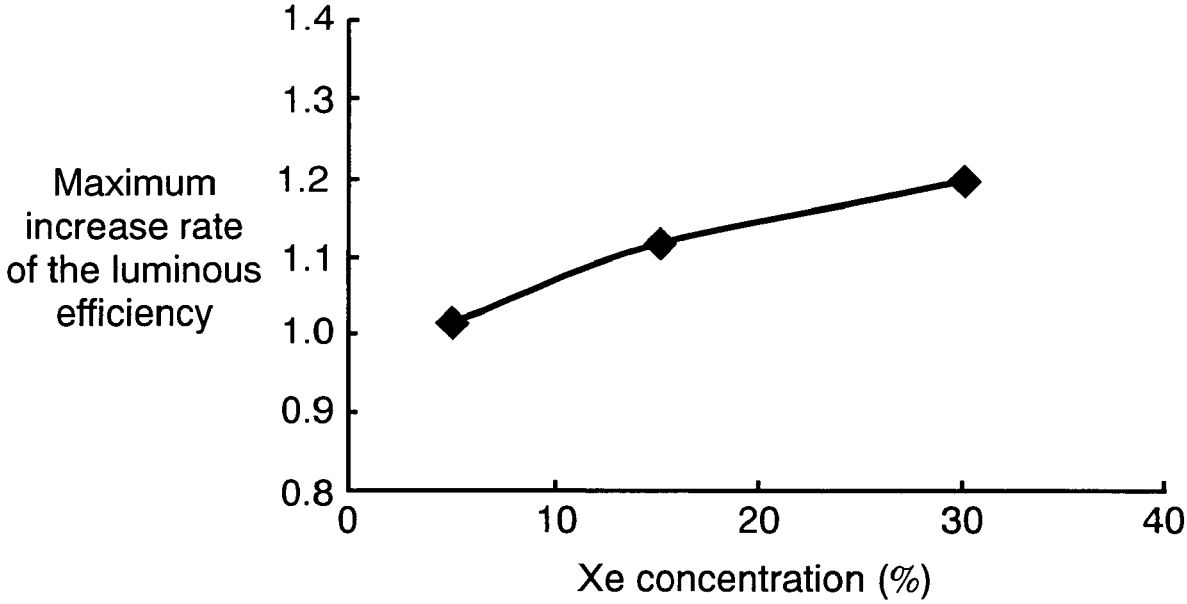
FIG. 7 illustrates the relationship between Xe concentration in the discharge gas and the maximum increase rate of luminous efficiency for the PDP.

FIG. 7 illustrates the relationship between Xe concentration in the discharge gas and the maximum increase rate of the luminous efficiency. As shown in FIG. 7, though the luminous efficiency does not increase significantly in Xe concentration of 5%, but a big increase is shown with Xe concentration of not lower than 5%, and further increase with the increase in Xe concentration. Namely, it proves that an increase in the luminous efficiency can be achieved effectively by adding $H_2$ content with Xe concentration of not lower than 5%.

The luminous efficiency described above is determined by the following formula:

$$\text{Luminous efficiency } \eta(lm/W) = \pi \times \text{brightness } (cd/m^2) \times \text{operating area } (m^2)/(\text{power for lighting} - \text{power for non-lighting})$$

From the above, $H_2$ content should not be higher than 0.1%, preferably not higher than 500 ppm, or more preferably not higher than 100 ppm to achieve a higher luminous efficiency when Xe concentration is not lower than 5%. That can realize approximately 20 V decrease in the discharge voltage and of the order of 20% further increase in the luminous efficiency at the same time compared with the case without any $H_2$ content.

The voltage lowering measures enable the PDP to decrease the discharge voltage and to reduce withstand voltage levels required for circuit parts or structure of the PDP, resulting in a cost reduction effectively.

Additionally, the voltage lowering measures also enable the PDP to operate on a lower drive voltage and to improve the luminous efficiency further if the drive voltage is optimized.

The above description results from the PDP with protective layer 8 composed of magnesium oxide (MgO) used as the main component. Considering the collision probability between the gases, the aforementioned $H_2$ concentration of the order of ppm is negligibly small from the collision theory, while resulting in significantly. Generally, hydrogen ($H_2$) decreases the electron temperature, causing the discharge voltage to increase. From the above, therefore, the results of the present invention can be considered as follows: Hydrogen ($H_2$) is considered to act on magnesium oxide (MgO) composing protective layer 8 forming a portion of internal surface of discharge space 14, allowing magnesium oxide (MgO) acting as a cathode to increase the electron emissivity. It is considered, therefore, that the materials of protective layer 8 should preferably include magnesium oxide (MgO) as the main component.

Although a flat-reflection type PDP is used in the above description, the present invention can be adopted for facing-discharge type PDP or tube-array type PDP as well, and particularly the improvement of luminous efficiency can be a more effective measure to reduce the power consumption in large-sized PDPs such as 60-inch and up.

INDUSTRIAL APPLICABILITY

As aforementioned, the present invention can reduce the drive voltage of the PDP and can perform displaying with high brightness by introducing a discharge gas including Xe of the concentration of not lower than 5% added with $H_2$ content, which would be useful for a plasma display apparatus for use in a wall-hung TV or large-sized screen monitor.

The invention claimed is:

1. A plasma display panel having two substrates positioned facing each other to form discharge spaces in between filled with discharge gas, wherein the discharge gas includes xenon (Xe) and hydrogen ($H_2$), such that a Xe concentration in the discharge gas is not lower than 5%, and such that an $H_2$ concentration in the discharge gas is not lower than 50 ppm and not higher than 0.1%.

2. The plasma display panel of claim 1, wherein the $H_2$ concentration in the discharge gas ranges from not lower than 50 ppm to not higher than 500 ppm.

3. The plasma display panel of claim 1, wherein magnesium oxide (MgO) is provided at least on a portion of an internal surface of the discharge spaces.

4. The plasma display panel of claim 1, wherein the discharge gas further includes at least one chosen from among helium (He), neon (Ne) and argon (Ar).

* * * * *